US008818232B2

(12) United States Patent
Fukuhara

(10) Patent No.: US 8,818,232 B2
(45) Date of Patent: Aug. 26, 2014

(54) IMAGE FORMING APPARATUS HAVING A CLEANING DEVICE WITH A COLLECTION MEMBER

(75) Inventor: Taku Fukuhara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 146 days.

(21) Appl. No.: 13/359,090

(22) Filed: Jan. 26, 2012

(65) Prior Publication Data

US 2013/0028627 A1 Jan. 31, 2013

(30) Foreign Application Priority Data

Jul. 27, 2011 (JP) ..... 2011-163899

(51) Int. Cl.
*G03G 15/16* (2006.01)
*G03G 15/01* (2006.01)

(52) U.S. Cl.
CPC ..... *G03G 15/161* (2013.01); *G03G 2215/0129* (2013.01); *G03G 15/0189* (2013.01)
USPC ..... 399/101

(58) Field of Classification Search
USPC ..... 399/71, 123, 149, 326, 345, 354, 357, 399/353
See application file for complete search history.

(56) References Cited

U.S. PATENT DOCUMENTS

| | | | | |
|---|---|---|---|---|
| 6,035,158 | A * | 3/2000 | Asakura et al. | 399/101 |
| 6,311,031 | B1 * | 10/2001 | Hirano | 399/101 |
| 7,471,924 | B2 * | 12/2008 | Shigezaki et al. | 399/349 |
| 2009/0245829 | A1 * | 10/2009 | Hamaya | 399/50 |
| 2011/0085834 | A1 * | 4/2011 | Naruse et al. | 399/350 |

FOREIGN PATENT DOCUMENTS

| | | | |
|---|---|---|---|
| JP | 2005-352008 | A | 12/2005 |
| JP | 2006-078853 | A | 3/2006 |
| JP | 2009-186812 | A | 8/2009 |

* cited by examiner

*Primary Examiner* — Clayton E LaBalle
*Assistant Examiner* — Victor Verbitsky
(74) *Attorney, Agent, or Firm* — Sughrue Mion, PLLC

(57) ABSTRACT

An image forming apparatus includes an image forming device including an image holding member; an intermediate transfer belt that holds on an outer surface thereof an developer image formed on the image holding member of the image forming device, and that rotates so as to transport the developer image up to a second transfer section, the intermediate transfer belt including a belt base material in which a resin particle is dispersed; a cleaning device including a plate member, the cleaning device performing a cleaning operation by at least contacting the plate member with a portion of an outer peripheral surface of the intermediate transfer belt that has passed the second transfer section; and a collecting member that removes and holds the resin particle existing at the outer peripheral surface of the intermediate transfer belt at least when the intermediate transfer belt is not used.

9 Claims, 9 Drawing Sheets

| | COLLECTING ROLLER | BIAS VOLTAGE | OCCURRENCES OF INITIAL IMPROPER CLEANING |
|---|---|---|---|
| COMPARATIVE EXAMPLE | NOT USED | NOT USED | 4 OUT OF 4 |
| FIRST EXAMPLE | USED | NOT USED | 3 OUT OF 5 |
| SECOND EXAMPLE | USED | POSITIVE VOLTAGE | 0 OUT OF 5 |

IMAGE FORMING APPARATUS HAVING A CLEANING DEVICE WITH A COLLECTION MEMBER

CROSS-REFERENCE TO RELATED APPLICATIONS

This application is based on and claims priority under 35 USC 119 from Japanese Patent Application No. 2011-163899 filed Jul. 27, 2011.

BACKGROUND (i) Technical Field

The present invention relates to an image forming apparatus.

(ii) Related Art

Among image forming apparatuses, such as facsimiles, copying machines, and printers that form images using developers, there are those that use an intermediate transfer system in which, after a developer image developed using a developer is formed on an image holding member such as a photoconductor member, the developer image is temporarily transferred to an outer peripheral surface of an intermediate transfer belt that rotates, and, then, the temporarily transferred developer image is second-transferred to a recording material such as recording paper. In general, image forming apparatuses using the intermediate transfer system include a cleaning device that removes and cleans off undesired substances, such as developers, remaining on the outer peripheral surface of the intermediate transfer belt after the second transfer by bringing a plate member, such as a blade, into contact with the outer peripheral surface of the intermediate transfer belt after the second transfer.

SUMMARY

According to an aspect (A1) of the invention, there is provided an image forming apparatus including an image forming device including an image holding member, a developer image developed with a developer being formed on the image holding member; an intermediate transfer belt that holds on an outer surface thereof the developer image formed on the image holding member of the image forming device, and that rotates so as to transport the developer image up to a second transfer section where the developer image is transferred to a recording material, the intermediate transfer belt including a belt base material in which a resin particle formed of polytetrafluoroethylene is dispersed; a cleaning device including a plate member, the cleaning device performing a cleaning operation by at least contacting the plate member with a portion of an outer peripheral surface of the intermediate transfer belt that has passed the second transfer section; and a collecting member that is disposed so as to be contactable with a portion of the outer peripheral surface of the intermediate transfer belt that is disposed upstream in a direction of rotation from and that is close to a position where the plate member of the cleaning device contacts the intermediate transfer belt, the collecting member removing and holding the resin particle existing at the outer peripheral surface of the intermediate transfer belt at least when the intermediate transfer belt is not used.

BRIEF DESCRIPTION OF THE DRAWINGS

Exemplary embodiments of the present invention will be described in detail based on the following figures, wherein.

DETAILED DESCRIPTION

Exemplary embodiments of the present invention will hereunder be described with reference to the drawings.

First Exemplary Embodiment

Figure 1:
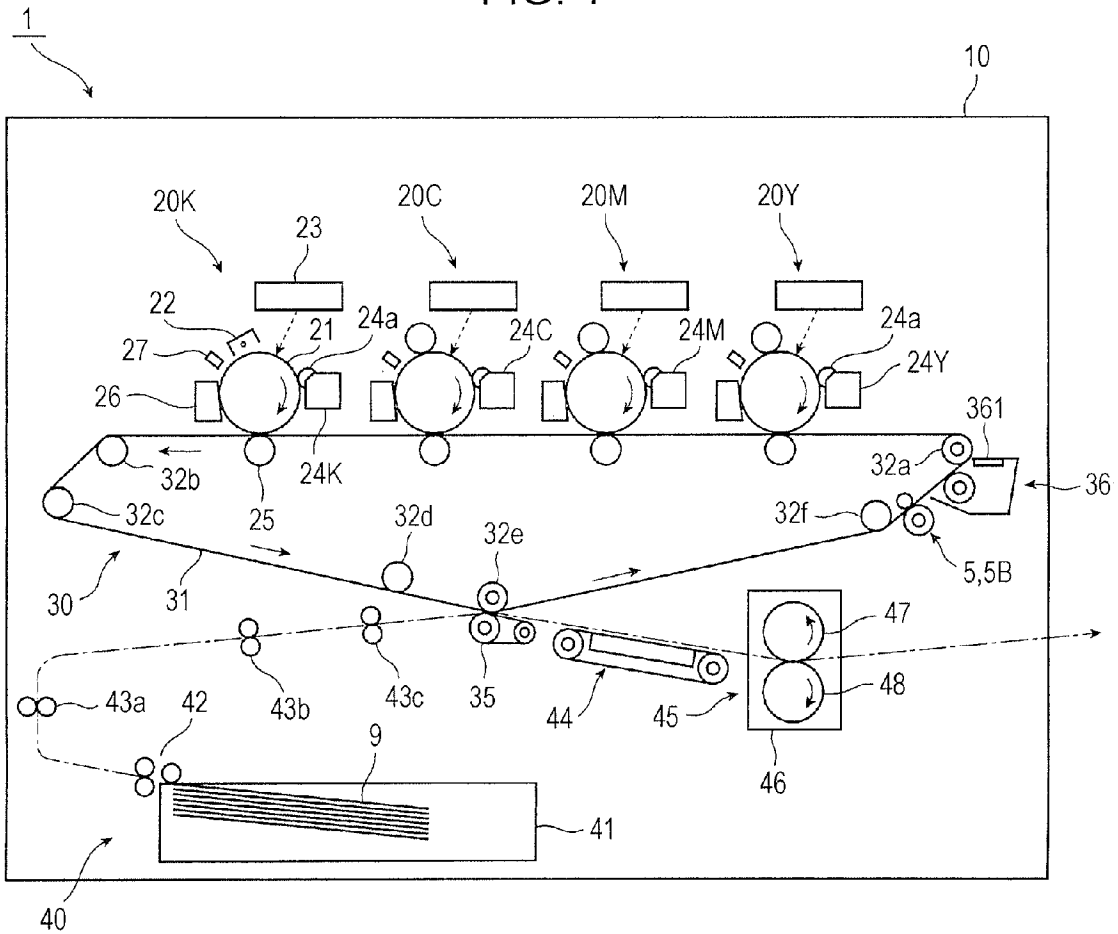
FIG. 1 is a schematic view of an image forming apparatus according to a first exemplary embodiment, etc.
Figure 2:
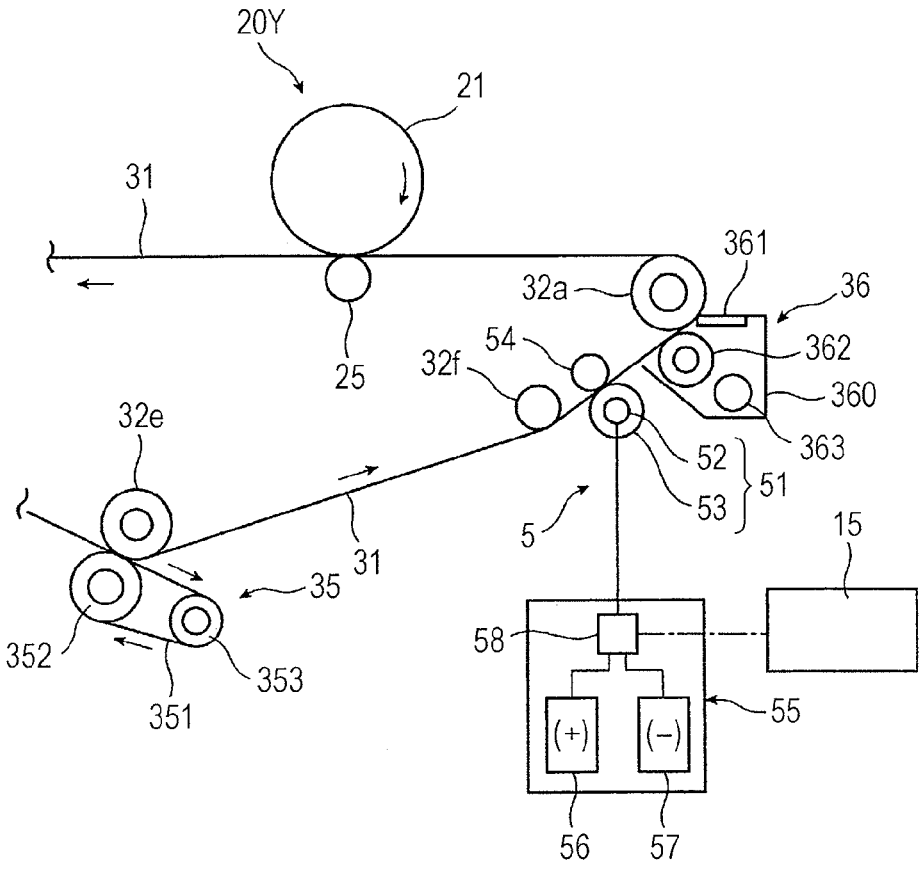
FIG. 2 is an enlarged view of principal portions (collecting device, belt cleaning device, etc.) of the image forming apparatus shown in FIG. 1.

FIGS. 1 and 2 each show an image forming apparatus 1 according to a first exemplary embodiment. FIG. 1 is a schematic view of the image forming apparatus 1. FIG. 2 shows principal portions (collecting device, etc.) in the image forming apparatus 1.

The image forming apparatus 1 is, for example, a color printer. The image forming apparatus 1 includes, for example, image forming devices 20, an intermediate transfer device 30, a sheet feeding device 40, and a fixing device 45 in an internal space of a housing 10. The image forming devices 20 form toner images that are developed using toner (fine powder that is, for example, colored) of a developer by using a publicly known image recording system (such as an electrophotographic system or an electrostatic recording system). The intermediate transfer device 30 holds the toner images formed at the corresponding image forming devices 20 to finally second-transfer the toner images to pieces of recording paper 9 serving as recording materials. The sheet feeding device 40 holds and transports the pieces of recording paper 9 to be supplied to a second transfer section of the intermediate transfer device 30. The pieces of recording paper 9 to which the toner images have been transferred at the intermediate transfer device 30 pass through the fixing device 45, so that the fixing device 45 fixes the toner images to the pieces of recording paper 9. At the housing 10, a supporting structural portion and an external portion are formed by, for example, a supporting member and an external cover. An alternate long and short dash line in FIG. 1 indicates a transport path along which the pieces of recording paper 9 are primarily transported in the housing 10.

The image forming devices 20 include four image forming devices 20Y, 20M, 20C, and 20K that specially form toner images of four colors (yellow (Y), magenta (M), cyan (C), and black (K)), respectively. The four image forming devices 20Y, 20M, 20C, and 20K are disposed in series in the internal space of the housing 10. The image forming devices 20Y, 20M, 20C, and 20K have substantially the same structure as described below.

As shown in FIGS. 1 and 2, each of the image forming devices 20Y, 20M, 20C, and 20K includes a photoconductor drum 21 that rotates. Each of the following devices is principally disposed around the corresponding photoconductor drum 21. The principal devices are, for example, charging devices 22, exposing devices 23, developing devices 24Y, 24M, 24C, and 24K, first transfer devices 25, drum cleaning devices 26, and electricity removing devices 27. The charging devices 22 charge image holding surfaces (outer peripheral surfaces) of the corresponding photoconductor drums 21 on which images are capable of being formed to predetermined potentials. The exposing devices 23 irradiate the charged outer peripheral surfaces of the photoconductor drums 21 with light based on image information (signal) to form electrostatic latent images (of corresponding colors) having potential differences. The developing devices 24Y, 24M, 24C, and 24K form toner images (serving as visible images) by developing the electrostatic latent images with toners, which are developers, of the corresponding colors (Y, M, C, and K). The first transfer devices 25 transfer the corresponding toner images to an intermediate transfer belt 31 of the intermediate transfer device 30. The drum cleaning devices 26 remove and clean off extraneous matter, such as toner, remaining on and adhered to the image holding surfaces of the corresponding photoconductor drums 21 after the transfer operations. The electricity removing devices 27 remove electricity from the image holding surfaces of the cleaned photoconductor drums 21.

Each photoconductor drum 21 has the image holding surface including a photoconductive layer (photosensitive layer) at a peripheral surface of a cylindrical or a columnar base material that is connected to ground. Each photoconductor layer is formed of a photosensitive material. Each photoconductor drum 21 receives power from a rotational driving device (not shown), and rotates in the direction of an arrow. Each of the charging devices 22 is a contact charging device including a contact member (such as a charging roller) that is disposed in contact with the image holding surface of the corresponding photoconductor drum 21 and to which a charging bias is supplied, or a contactless charging device that charges the image holding surface of the corresponding photoconductor drum 21 by corona discharge as a result of applying a charging current to a discharge wire disposed at a predetermined distance from the image holding surface of the corresponding photoconductor drum 21. In the first exemplary embodiment, for example, a contactless charging device is used at the black image forming device 20K, whereas contact charging devices are used at the image forming devices 20Y, 20M, and 20C of the remaining colors. When the developing devices 24 are those that perform reversal development, as the charging bias, a voltage or a current having a polarity that is the same as a charging polarity of the toner supplied from the developing devices 24 is supplied.

Each exposing device 23 forms an electrostatic latent image by irradiating the image holding surface of the charged photoconductor drum 21 with light (indicated by a dotted line with an arrow) provided in accordance with the image information input to the image forming apparatus 1. Although, the exposing devices 23 may be a scanning type that is formed using optical components such as semiconductor lasers and polygonal mirrors, they may also be a non-scanning type that is formed using, for example, light-emitting diodes and optical components. Image signals of corresponding color components are transmitted to the exposure devices 23. The image signals are obtained after image processing at an image processing device that is performed on information of print images input to the image forming apparatus 1. An image reading device, an information terminal such as a personal computer, or an image information device (not shown) such as a storage medium read/write device is connectable to the image forming apparatus 1 through a connecting communication section. The image information is input to the image forming apparatus 1 from the image information device.

The developing devices 24Y, 24M, 24C, and 24K use, for example, a two-component developer containing nonmagnetic toner and magnetic carriers. In each of the developing devices 24Y, 24M, 24C, and 24K, after stirring the two-component developer contained in a container housing, a portion of the developer is held by a corresponding developing roller 24*a* that rotates, and is transported to a development area that is close to and opposes the corresponding photoconductor drum 21. In each of the developing devices 24Y, 24M, 24C, and 24K, a development bias is applied to the corresponding developing roller 24*a* from a development power supply (not shown). The developing devices 24 are replenished with corresponding developers by developer replenishing systems (not shown). The two-component developer is frictionally charged to a predetermined polarity (a negative polarity in the exemplary embodiment) when the toner rubs against the carriers as a result of transporting the toner while stirring the toner in the container housing.

The first transfer devices 25 are contact transfer devices, each including a first transfer roller that rotates while contacting the image holding surface of the corresponding photoconductor drum 21 and to which a first transfer bias is applied. As the first transfer bias, for example, a direct-current voltage having a polarity that is opposite to a charging polarity of the toner is applied from a transfer power supply. The first transfer devices 25 may be handled as constituting the intermediate transfer device 30. The drum cleaning devices 26 each include, for example, an elastic plate formed of rubber that contacts and cleans the outer peripheral surface of the corresponding photoconductor drum 21.

As shown in FIG. 1, the intermediate transfer device 30 is disposed so as to exist below the image forming devices 20Y, 20M, 20C, and 20K. The intermediate transfer device 30 primarily includes the intermediate transfer belt 31, supporting rollers 32*a* to 32*f*, a second transfer device 35, and a belt cleaning device 36. The intermediate transfer belt 31 rotates in the directions of arrows while passing first transfer positions that are situated between the photoconductor drums 21 and the corresponding first transfer devices 25 (first transfer rollers). The supporting rollers 32*a* to 32*f* rotatably support the intermediate transfer belt 31 while holding it at a predetermined state from the inner surface of the intermediate transfer belt 31. The second transfer device 35 rotates while contacting with a predetermined pressure an outer peripheral surface (image holding surface) of the intermediate transfer belt 31 that is supported by the supporting roller 32*e*. The belt cleaning device 36 removes and cleans off extraneous matter, such as toner or paper powder, remaining on and adhered to the outer peripheral surface of the intermediate transfer belt 31 after the intermediate transfer belt 31 has passed the second transfer device 35.

Figure 3:
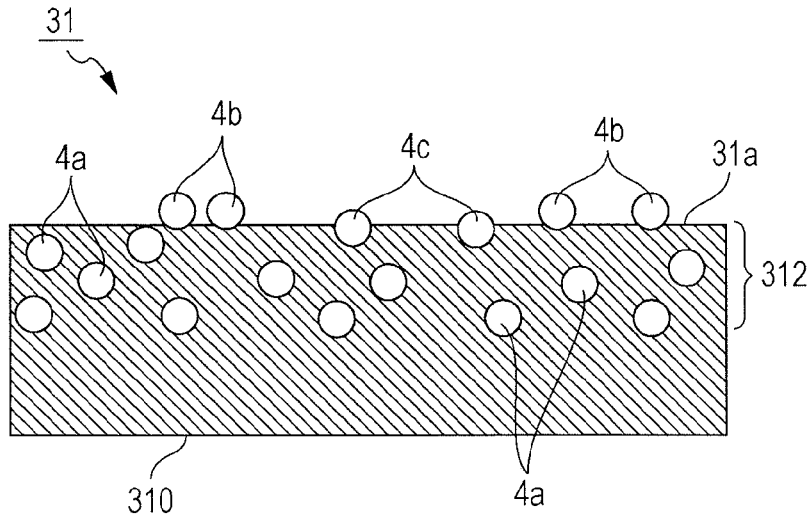
FIG. 3 is a schematic sectional view of a structure of an intermediate transfer belt used in the image forming apparatus shown in FIG. 1.

As shown in FIG. 3, the intermediate transfer belt 31 is an endless belt in which resin particles 4 formed of polytetrafluoroethylene (PTFE) are dispersed in a belt base material 310 for the purpose of providing separability with respect to the toner images (that is, for reducing adhesive force with respect to the toner images). The belt base material 310 is formed by dispersing a resistance regulating agent, such as carbon black, in synthetic resin, such as polyimide resin or polyamide resin. In the intermediate transfer belt 31, the resin particles 4 formed of PTFE are dispersed so as to exist at least in a surface layer 312 of the belt base material 310 (the resin particles exist in a state exemplified by reference numerals 4*a* in FIG. 3). The resin particles 4 formed of PTFE have average particle diameters on the order of from 200 to 250 nm. The average particle diameters of the resin particles 4 are less than the average particle diameters (such as 6 μm) of the toner particles of the developers used in the exemplary embodiment. Such an intermediate transfer belt 31 is manufactured by forming, for example, a surface layer on an outer surface of the belt base material 310, with the resin particles 4 formed of PTFE being dispersed at the surface layer. The surface layer is formed by providing a polyamic acid solution (serving as a layer forming material), applying the layer forming material to the outer surface of the belt base material 310, and drying the applied film. For example, carbon black and the resin particles 4 formed of PTFE are dispersed in the polyamic acid solution. The layer forming material (formed of the polyamic acid solution) may be, for example, a mixture of a polyamic acid solution in which carbon black is dispersed and a polyamic acid solution in which fluorocarbon resin is dispersed. The supporting roller 32*a* is a driving roller, and the supporting roller 32*c* is a tension applying roller.

As shown in FIGS. 1 and 2, the second transfer device 35 is a belt system in which an endless second transfer belt 351 is wound around the supporting rollers 352 and 353 and is supported thereby so as to rotate in the directions of arrows. The supporting roller 352 faces the supporting roller 32*e* with the intermediate transfer belt 31 and the second transfer belt 351 being disposed between the supporting roller 352 and the supporting roller 32*e*. The supporting roller 353 is separated from a portion of the intermediate transfer belt 31 that has passed the second transfer device 35. Of the supporting rollers 352 and 353, the supporting roller 352 is a driving roller. The second transfer belt 351 is an endless belt formed of, for example, chloroprene rubber or polyimide resin. A second transfer bias is supplied from a transfer power supply (not shown) to the supporting roller 32*e* for the intermediate transfer belt 31 or the supporting roller 352 for the second transfer device 35. As the second transfer bias, for example, a direct-current voltage having a polarity that is the same as (or opposite to) the charging polarity of the toner is supplied.

As shown in FIG. 2, the belt cleaning device 36 includes, for example, a body 360, a cleaning plate (cleaning blade) 361, a rotating brush 362, and a sending-out member 363. The body 360 is a container having an opening in a portion thereof. The cleaning plate 361 removes extraneous matter, such as residual toner, by contacting the outer peripheral surface of the intermediate transfer belt 31 that has passed a second transfer position. The rotating brush 362 contacts and cleans the outer peripheral surface of the intermediate transfer belt 31 at a location that is upstream from the cleaning plate 361 in the direction of rotation of the belt. The sending-out member 363, such as a screw auger, that is driven so that extraneous matter (such as toner) removed by the cleaning plate 361 is collected and sent out to a collecting system (not shown). As the cleaning plate 361, a plate member formed of, for example, rubber is used.

The sheet feeding device 40 is disposed so as to exist below the intermediate transfer device 30. The sheet feeding device 40 primarily includes a sheet holding member (or sheet holding members 41) and a sending-out device 42. The sheet holding member 41 is mounted so that it is capable of being drawn out towards a front side (that is, a side surface that an operator faces when the operator uses the sheet feeding device 40) of the housing 1, and holds the pieces of recording paper 9 of, for example, a predetermined size and a predetermined type while the pieces of recording paper 9 are stacked upon each other. The sending-out device 42 sends out the pieces of recording paper 9 one at a time from the sheet holding member 41. The pieces of recording paper 9 sent out from the sheet feeding device 40 are transported to the second transfer position of the intermediate transfer device 30 (situated between the intermediate transfer belt 31 and the second transfer belt 351 of the second transfer device 35) through a transport path formed by a transport guide member and, for example, pairs of sheet transporting rollers 43*a*, 43*b*, and 43*c*. A transporting device 44 that transports the pieces of recording paper 9 after the second transfer to the fixing device 45 is set between the second transfer device 35 and the fixing device 45. For example, a suction-type belt transporting device is used as the transporting device 44.

The fixing device 45 includes a heating rotating member 47 and a pressing rotating member 48, which are set in the interior of a housing 46. The heating rotating member 47 rotates in the direction of an arrow, and is heated by a heating unit so that its surface temperature is maintained at a predetermined temperature. The pressing rotating member 48 contacts the heating rotating member 47 at a predetermined pressure substantially along an axial direction of the heating rotating member 47, and is driven and rotated. The pieces of recording paper 9 on which the toner images have been fixed by the fixing device 45 are transported to and held by a discharge section through a discharge transport path formed by pairs of transporting rollers and a transport guide member. The discharge section is set at, for example, the housing 10.

A basic image forming operation (printing operation) by the image forming apparatus 1 is performed as follows. Here, an image forming operation pattern (full-color mode) for forming a full-color image formed by combining toner images of four colors (Y, M, C, K) formed by using all four image forming devices 20Y, 20M, 20C, and 20K is described.

When there is a request for an image forming operation (printing operation) from, for example, the image information device, in the four image forming devices 20Y, 20M, 20C, and 20K, first, the photoconductor drums 21 rotate in the directions of the arrows, and the charging devices 22 charge the image holding surfaces of the corresponding photoconductor drums 21 to a predetermined polarity (a negative polarity in the exemplary embodiment) and a predetermined potential. Then, the exposing devices 23 perform exposure by irradiating the surfaces of the corresponding charged photoconductor drums 21 with light emitted on the basis of image data divided into pieces of image data corresponding to the color components (Y, M, C, and K) and transmitted from an image processing device. This causes electrostatic latent images of the corresponding color components, formed by predetermined potential differences, to be formed.

Next, from the developing rollers 24*a*, the developing devices 24Y, 24M, 24C, and 24K supply toners of the corresponding colors (Y, M, C, and K) charged to a predetermined polarity (negative polarity) to the electrostatic latent images of the corresponding colors formed on the photoconductor drums 21, so that the toners electrostatically adhere to the electrostatic latent images. By performing the development in this way, the electrostatic latent images of the corresponding color components formed on the corresponding photoconductor drums 21 are developed by the toners of the corresponding colors, and made visible as toner images of the four colors (Y, M, C, and K). Next, the toner images of the corresponding colors formed on the photoconductor drums 21 of the corresponding image forming devices 20Y, 20M, 20C, and 20K are first-transferred by the first transfer device 25 so as to placed upon each other in turn on the intermediate transfer belt 31 of the intermediate transfer device 30. The drum cleaning devices 26 remove and clean off extraneous matter, such as toner, remaining on the outer peripheral surfaces of the photoconductor drums 21 after the first transfer in the corresponding image forming devices 20. Then, the electricity removing devices 27 remove electricity of the cleaned outer peripheral surfaces.

The intermediate transfer device 30 holds the toner images first-transferred to the intermediate transfer belt 31, and transports the toner images to the second transfer position where the intermediate transfer belt 31 contacts and opposes (the second transfer belt 351 of) the second transfer device 35. Then, at the second transfer position, the toner images on the intermediate transfer belt 31 are second-transferred together to a sheet 9 that is transported and sent from the sheet feeding device 40. In the exemplary embodiment, since, as mentioned above, the intermediate transfer belt 31 is a belt in which PTFE resin particles are dispersed, the toner images are properly separated from the intermediate transfer belt and are transferred to the sheet in the second transfer, as a result of which a relatively high second transfer rate is obtained. The belt cleaning device 36 removes and cleans off extraneous matter, such as toner, remaining on the outer peripheral surface of the intermediate transfer belt 31 after the second transfer.

Next, after the sheet 9 to which the toner images have been second-transferred has been transported to the second transfer belt 351 and separated from the intermediate transfer belt 31, the sheet 9 is transported to the fixing device 45 by the transporting device 44. Then, when the sheet 9 is transported through the fixing device 45 and subjected to fixing operations (using heat and pressure), the toner images are fixed to the sheet 9. When only one side of the sheet 9 after the completion of the fixing operations is to be subjected to an image forming operation, the sheet 9 is discharged to and held by a discharge holding section (not shown) formed at, for example, the housing 10.

By the above-described operations, the sheet 9 on which a full-color image is formed by combining the toner images of the four colors is output.

In the image forming apparatus 1, as mentioned above, the intermediate transfer belt 31 is a belt having the PTFE resin particles 4 dispersed in the interior of the belt base material 310 (that is, at least at the surface layer 312). As exemplified in FIG. 3, some resin particles 4*b* and 4*c* may exist at an outer peripheral surface 31*a* of the intermediate transfer belt 31 at least when the intermediate transfer belt 31 is not used.

Figure 12A:
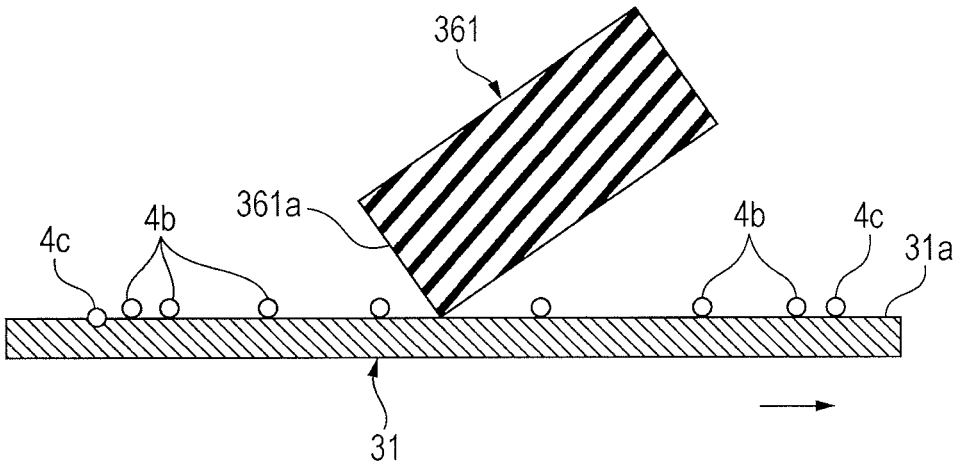
FIG. 12A is a schematic view of a state of PTFE resin particles existing at an outer peripheral surface of the intermediate transfer belt at least when the intermediate transfer belt is not used.

The resin particles 4*b* and 4*c* existing at the outer peripheral surface 31*a* of the intermediate transfer belt 31 are such that the resin particles 4*b* primarily exist in a floating state from the belt base material and the resin particles 4*c* primarily exist in a partially exposed state to the outside. Although many resin particles 4*b* and 4*c* are generated particularly when the intermediate transfer belt 31 is not used (that is, when a first rotating operation is not performed in the image forming apparatus), the resin particles 4*b* and 4*c* may be generated, for example, when an image forming operation is not performed for a long time. Therefore, as shown in FIG. 12A, when the intermediate transfer belt 31 is mounted as a portion of the intermediate transfer device 30 to the image forming apparatus 1, and is not used, the PTFE resin particles 4*b* and 4*c* exist at the outer peripheral surface 31*a* of the intermediate transfer belt 31.

Figure 12B:
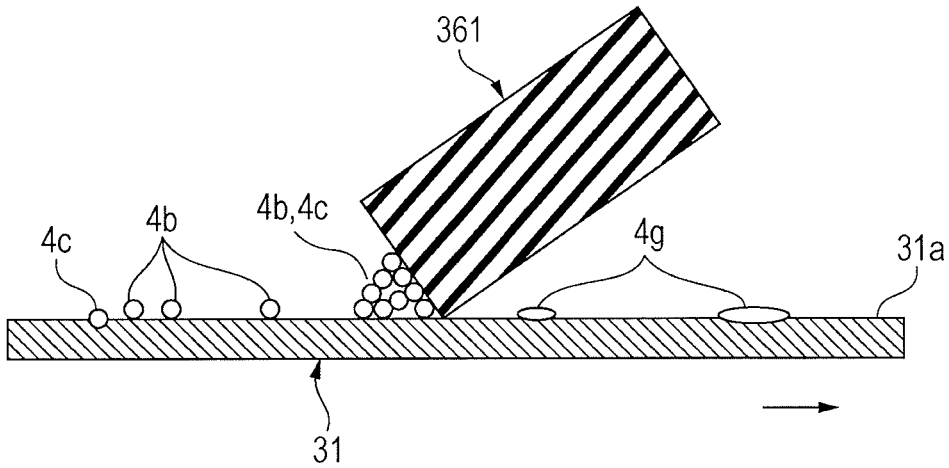
FIG. 12B is a schematic view of, for example, a state in which the PTFE resin particles in FIG. 12A are gathered and stopped at a cleaning plate of a belt cleaning device.

At an initial stage in which a first rotational driving operation is performed in the image forming apparatus 1, as shown in FIG. 12B, the resin particles are gathered and stopped in a wedge-shaped space between the belt outer peripheral surface 31*a* and an end (free end) 361*a* of the cleaning plate 361 of the belt cleaning device 36 that contacts the belt outer peripheral surface 31*a*. At this time, the resin particles 4*c* existing in an exposed state are also gathered by the end 361*a* of the cleaning plate 361. Reference numeral 4*g* in FIG. 12B denotes a film formed when, for example, the resin particles 4*b* that have moved passed the cleaning plate 36 have been spread on the belt outer peripheral surface 31*a* as described later.

When the resin particles 4*b* and 4*c* are first stopped at the end 361*a* of the cleaning plate 361 of the cleaning device 36 in this way, friction force (coefficient of kinetic friction) of the end 361*a* of the cleaning plate with respect to the belt outer peripheral surface 31*a* is reduced, thereby varying a state when the end 361*a* of the cleaning plate contacts the belt outer peripheral surface 31*a*. As a result, particularly in, for example, an image forming operation during initial use of the intermediate transfer belt 31, in the cleaning device 36, residual toner remaining after the second transfer passes through a space between the cleaning plate 361 and the belt outer peripheral surface 31*a*. As a result, it is not possible to properly remove the residual toner from the belt outer peripheral surface 31*a*. This results in improper cleaning.

Therefore, as shown from, for example, FIG. 1 to FIG. 3, the image forming apparatus 1 is provided with a collecting device 5 that removes and holds the PTFE resin particles 4*b* and 4*c* existing at the outer peripheral surface of the intermediate transfer belt 31 at least when the intermediate transfer belt 31 is not used.

The collecting device 5 includes a collecting roller 51 and a power supplying device 55. The collecting roller 51 is disposed so as to be contactable with a portion of the outer peripheral surface of the intermediate transfer belt 31 that is disposed upstream in a direction of rotation from and that is close to (just in front of) a position where the end 361*a* of the plate member 361 of the cleaning device 36 contacts the intermediate transfer belt 31. The power supplying device 55 selects a bias voltage having a different polarity, and supplies it to the collecting roller 51.

The collecting roller 51 includes a porous layer 53 formed around a conductive shaft 52. The collecting roller 51 is set so that the porous layer 53 contacts and rotates along the outer peripheral surface 31*a* of the intermediate transfer belt 31 that rotates. The porous layer 53 is formed of, for example, resin foam (urethane foam). The porous layer 53 may also be formed of foam rubber such as ethylene propylene diene monomer (EPDM) rubber or epichlorohydrin rubber.

The collecting roller 51 according to the exemplary embodiment is disposed at a position (within a section) between the belt cleaning device 36 and the first supporting roller or the supporting roller 34*f* disposed upstream in the direction of rotation from the cleaning device 36. Even if it is difficult to, for example, provide a setting space for the collecting roller 51, it is desirable to dispose the collecting roller 51 at least at a position (within a section) between the belt cleaning device 36 and the second transfer device 35 (that is, a portion that contacts the second transfer belt 351 supported at the supporting roller 352).

Although, in the collecting device 5 according to the exemplary embodiment, a back supporting roller 54 is set so as to oppose the collecting roller 51 with the intermediate transfer belt 31 being disposed therebetween, it is possible not to set the back supporting roller 54. If the collecting roller 51 is set so as to oppose the supporting roller 32*f* for the intermediate transfer belt 31, it is possible to use the supporting roller 32*f* as the back supporting roller. When the back supporting roller 54 is provided, the supporting roller 54 may be connected to ground.

As shown in FIG. 2, the power supplying device 55 includes a direct-current power supplying section 56 having a positive polarity, a direct-current power supplying section 57 having a negative polarity, and a switching section 58 that switches and outputs direct-current voltages having different polarities from the direct-current power supplying sections 56 and 57. The switching section 58 is electrically connected to the shaft 52 of the collecting roller 51. Each operation of, for example, the switching section 58 of the power supplying device 55 is, for example, controlled on the basis of a control signal transmitted from a controlling device 15 that controls each operation of the image forming apparatus 1.

In order for the collecting roller 51 to electrostatically attract the PTFE resin particles 4*b* and 4*c* existing at the peripheral surface 31*a* of the intermediate transfer belt 31 to remove and hold the PTFE resin particles 4*b* and 4*c*, the power supplying device 55 supplies a direct-current voltage having a positive polarity that is opposite to a charging polarity (negative polarity) of the PTFE particles for a predetermined period. In order for the PTFE resin particles 4*b* and 4*c* electrostatically attracted to and held by the collecting roller 51 to be electrostatically ejected and returned to the outer peripheral surface 31*a* of the intermediate transfer belt 31, the power supplying device 55 supplies a direct-current voltage having a negative polarity that is the same as the charging polarity of the PTFE resin particles for a predetermined period.

A period when the direct-current voltage having a positive polarity is supplied corresponds to an initial stage in which the intermediate transfer belt 31 is rotated for a first time as described in detail below. For example, this period corresponds to an operation period (such as a setup control period) when the intermediate transfer belt 31 is rotated for the first time by turning on a power supply of the image forming apparatus 1 for the first time. The image forming apparatus 1 may be formed so that, as one controlling operation of the image forming apparatus 1, a controlling operation (collecting mode) for collecting the PTFE resin particles 4*b* and 4*c* is executed. Such an initial period when the intermediate transfer belt 31 is rotated for the first time is, in other words, a period in which the intermediate transfer belt 31 rotates when (the toner particles of) the developers are not stopped at the end 361*a* of the cleaning plate 361 of the belt cleaning device 36.

The supply of the direct-current voltage having a positively polarity is stopped after passage of the initial stage when the intermediate transfer belt 31 is rotated for the first time. The period when the supply of the direct-current voltage is stopped is, for example, a period in which the intermediate transfer belt 31 has rotated at least once or two or three times, or a period when (the toner particles of) the developers are expected to be stopped at the end 361*a* of the cleaning plate 361 of the belt cleaning device 36.

The period when the direct-current voltage having a negative polarity is supplied corresponds to when a cumulative amount of rotation of the intermediate transfer belt 31 has reached a preset threshold value. For example, it is capable of being used when a cumulative value obtained by determining the number of sheets on which images are formed has reached a predetermined threshold value.

Next, the operation of the collecting device 5 will be described.

Figure 4:
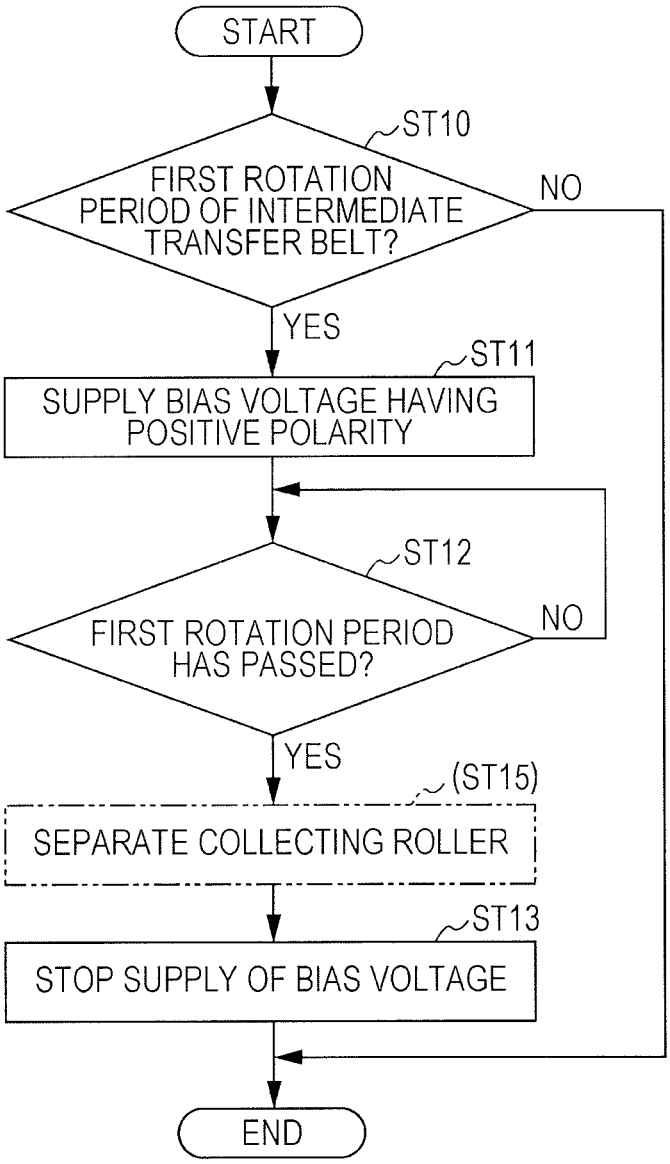
FIG. 4 is a flowchart of the steps of a collecting operation of the collecting device.

As shown in FIG. 4, in the image forming apparatus 1, the controlling device 15 determines whether or not the intermediate transfer belt 31 is in the first rotation period (Step 10: ST10). In the exemplary embodiment, the image forming apparatus 1 is set so that this determination is made by detecting whether or not the period when the power supply of the image forming apparatus 1 is turned on for the first time and a setup control operation is executed has arrived. In the setup control operation, for example, the intermediate transfer belt 31 rotates approximately 10 times. If the controlling device 15 determines that the intermediate transfer belt 31 is not in the first rotation period in Step S10, subsequent operations of the collecting device 5 are not performed.

If the controlling device 15 determines that the intermediate transfer belt 31 is in the first rotation period in Step S10, the intermediate transfer belt 31 is rotated for the first time by the setup control operation, and the power supplying device 55 of the collecting device 5 supplies a direct-current voltage having a positive polarity to the collecting roller 51 on the basis of a control command from the controlling device 15 (ST11). More specifically, in the power supplying device 55, the switching section 58 is connected to the direct-current power supplying section 56 having a positive polarity.

Figure 5A:
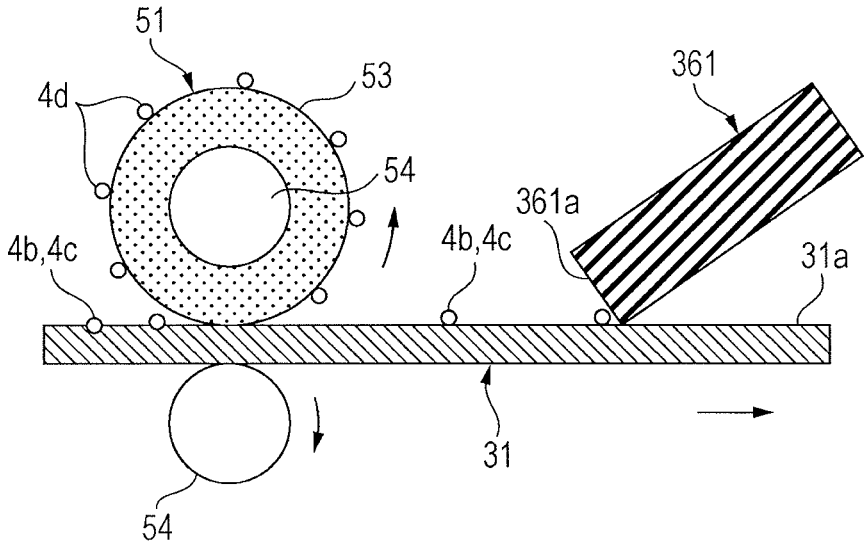
FIG. 5A is a schematic view of, for example, a collecting operation state of the collecting device.

Therefore, as shown schematically in FIG. 5A, the PTFE resin particles 4*b* and 4*c* (see FIG. 3), existing at the outer peripheral surface 31*a* of the intermediate transfer belt 31 in, for example, a floating state and an exposed state when the intermediate transfer belt 31 is not used, are primarily electrostatically attracted to the collecting roller 51 to which a direct-current voltage having a positive polarity is supplied. This causes the collecting roller 51 to remove and hold the PTFE resin particles. More specifically, the PTFE resin particles 4*b* and 4*c* having a negative charging polarity existing at the outer peripheral surface 31*a* of the intermediate transfer belt 31 are electrostatically attracted to the porous layer 53 of the collecting roller 51, so that the PTFE resin particles are held while adhering to the outer surface of the porous layer 53 or while existing in holes of the outer surface of the porous layer 53.

As a result, in the belt cleaning device 36 disposed downstream in the direction of rotation of the belt from and close to the collecting roller 51 of the collecting device 5, even if the intermediate transfer belt 31 is rotated for the first time, the PTFE resin particles 4*b* and 4*c* existing at the outer peripheral surface 31*a* of the intermediate transfer belt 31 are removed by the collecting device 5 disposed upstream from and close to the PTFE resin particles 4*b* and 4*c*. Therefore, the PTFE resin particles 4*b* and 4*c* are not gathered and stopped between the belt outer peripheral surface 31*a* and the end 361*a* of the cleaning plate 361 (see FIG. 12B). The small number of PTFE resin particles 4*b* and 4*c* existing at the belt outer peripheral surface 31*a* within the section between the collecting roller 51 and the end 361*a* of the cleaning plate 361 before the intermediate transfer belt 31 rotates for the first time are sometimes stopped by the end 361 of the cleaning plate 361. However, this does not reduce the cleaning performance.

The controlling device 15 determines whether or not the initial rotation period of the intermediate transfer belt 31 has passed (ST12). In the exemplary embodiment, for example, the controlling device 15 is set so as to make the determination by detecting whether or not the aforementioned setup control operation has ended.

If, in Step ST12, the controlling device 15 determines that the first rotation period has passed, the supply of the direct-current voltage having a positive polarity from the power supplying device 55 of the collecting device 5 is stopped on the basis of a control command from the controlling device 15 (ST13). More specifically, in the power supplying device 55, the switching section 58 changes its switching state to a state in which it is disconnected from the direct-current power supplying section 56 having a positive polarity.

This prevents the PTFE resin particles 4*b* and 4*c* existing at the outer peripheral surface 31*a* of the intermediate transfer belt 31 from being excessively removed by the collecting roller 51. In addition, residual toner charged to a negative polarity and remaining after the second transfer when a first image forming process has been performed by the image forming apparatus 1 are prevented from accidentally and electrostatically adhering to and being held by the collecting roller 51. Further, the adhered toner is prevented from contaminating the surface of the collecting roller 51.

Figure 5B:
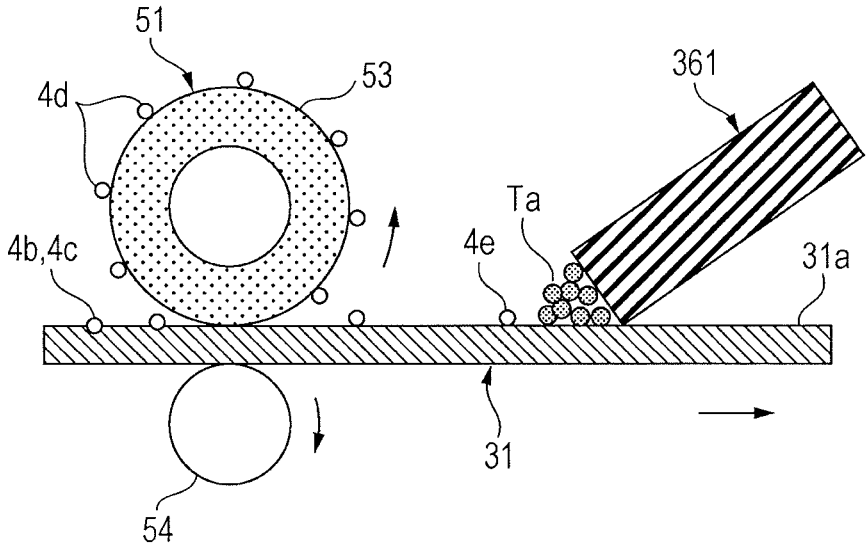
FIG. 5B is a schematic view of, for example, a state of the belt cleaning device after the collecting operation.

In the image forming apparatus 1, when the setup control operation ends and the first image forming process is performed, as shown in FIG. 5B, residual toner Ta remaining after the second transfer is gathered and accumulated at the end 361*a* of the cleaning plate 361 of the belt cleaning device 36 (that is, an accumulation of toner results). When the residual toner Ta is gathered and accumulated at the end 361*a* of the cleaning plate 361 in this way, even if, for example, PTFE resin particles 4*e* that have dropped from the collecting roller 51 reach the residual toner Ta, there is no possibility of a reduction in friction force of the end 361*a* of the cleaning plate 361 with respect to the belt outer peripheral surface 31*a*. The accumulation of toner results when control toner images (patch images) are stopped at the cleaning plate 36. The control toners are formed on the outer peripheral surface of the intermediate transfer belt 31 by being transferred from the image forming devices 20 during the setup control operation.

Even if the image forming process is executed with the collecting device 5 being provided, the belt cleaning device 36 properly cleans the outer peripheral surface 31*a* of the intermediate transfer belt 31, so that improper cleaning occurring particularly during an initial stage of use of the image forming apparatus 1 when the PTFE resin particles 4*b* and 4*c* are stopped at the end of the cleaning plate 361 is reduced. The initial stage of use of the image forming apparatus 1 corresponds to a period when images are formed on approximately 10 sheets, this being equivalent to the number of sheets subjected to the first image forming process.

Figure 6:
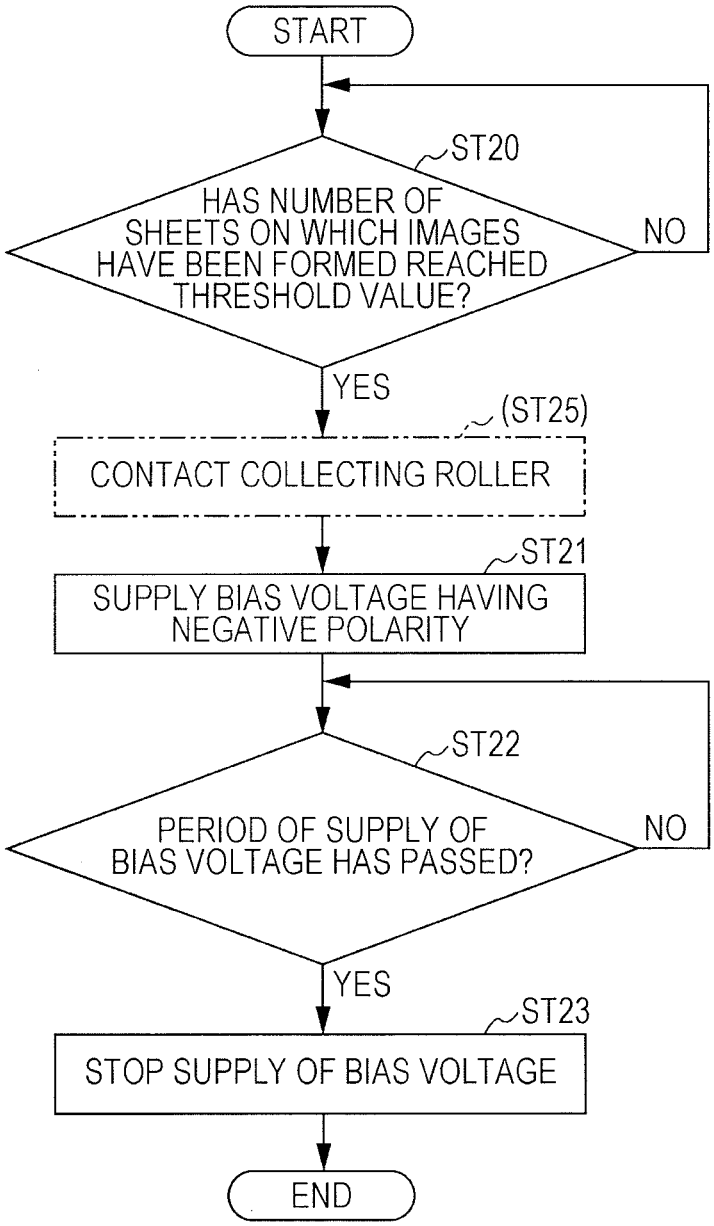
FIG. 6 is a flowchart of the steps of an ejecting operation in the collecting device.

In the image forming apparatus 1, as shown in FIG. 6, the controlling device 15 determines whether or not a cumulative value of the number of sheets on which images have been formed (the number of printed sheets) has reached a preset threshold value (the number of sheets) (ST20). The threshold value at this time is set with reference to, for example, a prediction period in which a second transfer rate is reduced as a result of a reduction in separability (an increase in toner adhesive force) at the outer peripheral surface 31*a* of the intermediate transfer belt 31 with time.

If, in Step ST20, the controlling device 15 determines that the number of sheets on which images have been formed has reached the threshold value, a direct-current voltage having a negative polarity is supplied to the collecting roller 51 from the power supplying device 55 of the collecting device 5 on the basis of a control command from the controlling device 15 (ST22). More specifically, in the power supplying device 55, the switching section 58 is switched to a state in which it is connected to the direct-current power supplying section 57 having a negative polarity.

Figures 7, 8:
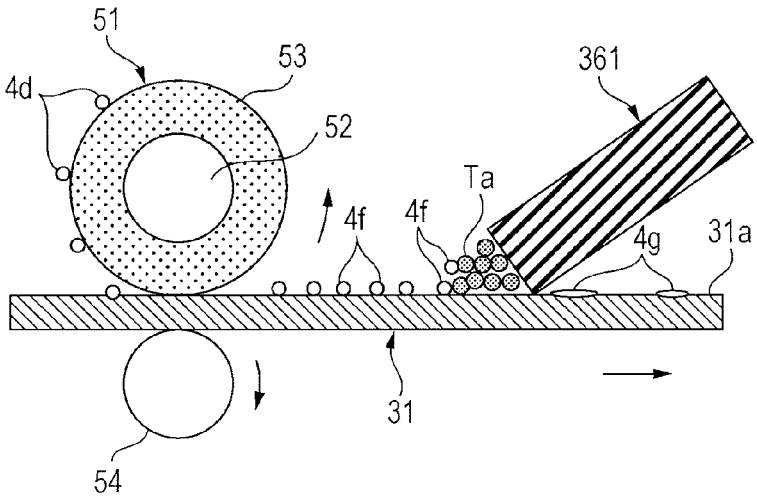
FIG. 7 is a schematic view showing a state in which the collecting device is performing ejection and a state of the belt cleaning device.
FIG. 8 is a table showing the conditions and results of evaluation tests of initial improper cleaning operations.

Therefore, as shown schematically in FIG. 7, PTFE resin particles 4*d* held by the collecting roller 51 of the collecting device 5 are subjected to repulsive electrostatic force generated by the direct-current voltage having a negative polarity, so that PTFE resin particles 4*d* are ejected from the collecting roller 51, and are returned as resin particles 4*f* to the outer peripheral surface 31*a* of the intermediate transfer belt 31. At this time, toner particles charged to a negative polarity and adhered to and held by the collecting roller 51 also receive the repulsive electrostatic force, so that they are ejected towards the belt outer peripheral surface 31*a* from the collecting roller 51.

The PTFE resin particles 4*f* ejected to the belt outer peripheral surface 31*a* from the collecting roller 51 reach and temporarily stop at the end 361*a* of the cleaning plate 361 of the belt cleaning device 36. However, since the accumulation of the residual toner Ta exists at the end 361*a* of the cleaning plate 361, the PTFE resin particles 4*f* gradually pass the end 361*a* of the cleaning plate 361 without the friction force of the end being reduced when the PTFE resin particles 4*d* are stopped at the end 361*a* of the cleaning plate 361. Therefore, there is no possibility of improper cleaning caused by the ejected PTFE resin particles 4*f*.

Due to the spreading property of the resin itself, the resin particles 4*f* that have passed the end 361*a* of the cleaning plate 361 are widened and spread by pressure that they receive when they pass the end 361*a* of the cleaning plate, and become, for example, thin films 4*g*. As a result, since the outer peripheral surface 31*a* of the intermediate belt 31 has separability, toner images are properly separated from the intermediate transfer belt 31 during the second transfer, and are second-transferred, thereby increasing the second transfer rate. In particular, when surface characteristics (particularly separability) of the intermediate transfer belt 31 deteriorate with time, the second transfer rate is improved by imparting separability by the resin particles 4*f* and the films 4*g* (see FIG. 9). When the toner particles adhered to the collecting roller 51 are ejected as described above, contamination of the surface of the collecting roller 51 by the toner is eliminated, so that, afterwards, the resin particles 4 are properly removed and held.

The controlling device 15 determines whether or not the period of supply of bias voltage having a negative polarity has passed (ST22). In the exemplary embodiment, for example, the controlling device 15 is set so as to make the determination by detecting whether or not the remaining image forming operations, performed subsequent to the reaching of the number of sheets on which images have been formed, to the threshold value have ended. Alternatively, for example, the determination may be performed by detecting whether or not the number of rotations of the intermediate transfer belt 31 has reached a predetermined value.

If the controlling device 15 determines that the period of supply of the bias voltage has passed in Step ST22, the supply of direct-current voltage having a negative polarity to the collecting roller 51 from the power supplying device 55 of the collecting device 5 is stopped on the basis of a control command from the controlling device 15 (ST23). More specifically, in the power supplying device 55, the switching section 58 is switched to a state in which it is disconnected from the direct-current power supplying section 57 having a negative polarity.

By the above-described operations, all the basic operations of the collecting device 5 end.

When, in Step ST10 in FIG. 4, the first rotation period of the intermediate transfer belt is set so as to include, for example, a first rotation period when a power supply is turned on in a second image forming process and subsequent image forming processes, and a first rotation period when the power supply is turned on after it is determined that the image forming apparatus 1 is not used for a predetermined long time, operations of the collecting device 5 similar to those described above are performed when each rotation period arrives. In this case, the determination of whether or not the number of sheets on which images have been formed has reached the threshold value in Step S20 is performed by determining whether or not the cumulative value has reached the threshold value. The cumulative value is that of the number of sheets on which images are formed by the image forming process subsequent to the ending of the ejection of the PTFE resin particles just before the determination.

Evaluation Tests

Evaluation tests performed using, for example, the image forming apparatus 1 according to the exemplary embodiment, etc. will hereunder be described.

In the evaluation tests, first, as shown in FIG. 8, a case in which bias voltage was not supplied from the power feeding device 55 when the collecting roller 51 of the collecting device 5 was set, and initial improper cleaning occurrence states when the bias voltage was not supplied were examined. For comparison (in a comparative example), an image forming apparatus not including a collecting roller 51 of a collecting device 5 was also provided.

Here, four or five image forming apparatuses having the same structure were provided. As the intermediate transfer belt 31, the same unused product in which PTFE resin particles 4 were dispersed in the belt base material 310 formed of polyimide resin was used. The intermediate transfer belt 31 was rotated at a speed of 440 mm/s. As the collecting roller 51, a roller having a diameter of 28 mm and including a urethane-foam porous layer 53 formed around a shaft was used. The bias voltage that was supplied was +200 V. As the cleaning plate 361 of the belt cleaning device 36, a cleaning blade formed of rubber and having a thickness of 1.9 mm was used. As the developer, a two-component developer containing magnetic carriers and nonmagnetic toner having an average particle diameter of 6 μm was used.

When the collecting roller 51 was provided (examples), the PTFE resin particles were collected by the collecting roller 51 by rotating the intermediate transfer belt 31 only twice. As regards initial improper cleaning operations, after the collecting operation ended, 10 test images having half tones (area coverage of 20%) over the entire surfaces were formed for 10 sheets, and whether or not there were streaked image quality defects was checked, to evaluate the occurrences of improper cleaning. The evaluation results are given in the table shown in FIG. 8.

As shown by the results in FIG. 8, it was confirmed that it was possible to reduce the occurrence of initial improper cleaning even if the bias voltage was not supplied to the collecting roller 51 (first example). That is, even in this case, it is possible to presume that the PTFE resin particles are collected by the collecting roller 51. In addition, it was confirmed that it was possible to prevent initial improper cleaning when the bias voltage was supplied to the collecting roller 51 (second example). That is, it is possible to presume that the PTFE resin particles are reliably collected by the collecting roller 51. When the outer peripheral surface 31*a* of the intermediate transfer belt 31 after supplying the bias voltage and after collecting the PTFE resin particles was magnified with, for example, a magnifier and observed, the existence of floating PTFE resin particles 4*b* could not be actually confirmed.

Figure 9:
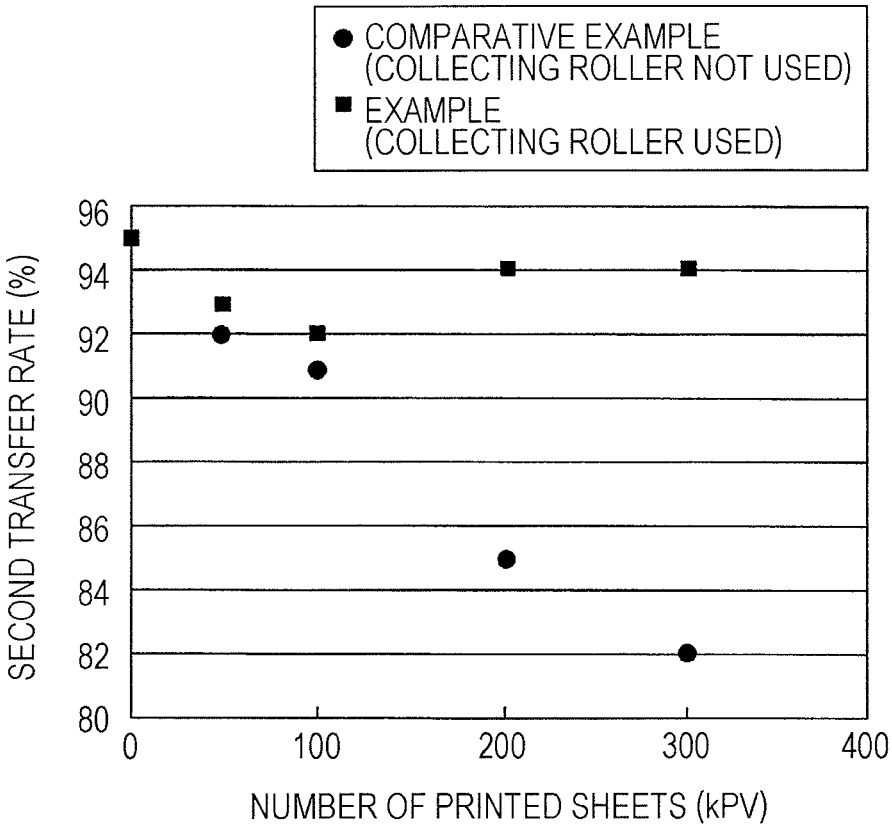
FIG. 9 is a graph of the results of evaluation tests regarding the number of prints and states of variations of second transfer rates in an example and a comparative example.

Next, in the evaluation tests, as indicated in FIG. 9, second transfer rates (%) after forming the test images for 50,000 sheets (50 kPV), 130 kPV, 200 kPV, and 300 kPV were checked using the image forming apparatuses according to the comparative example and the second example.

The second transfer rates are measured by determining a second-transfer percentage based on a measured amount of toner before second transfer at the intermediate transfer belt 31 and a measured residual toner amount after the second transfer. In the example, the test images were formed after collecting the PTFE resin particles. In addition, in the example, a direct-current voltage (−200 V) having a negative polarity was applied to the collecting roller 51 after image formation at 100 kPV had ended while the intermediate transfer belt 31 rotated twice. The results are given in the table shown in FIG. 9.

As indicated by the results shown in FIG. 9, in the example and the comparative example, the second transfer rates are reduced as the image forming operations are continued. In particular, the second transfer rate after the image forming operation performed at 200 kPV ends is markedly reduced. When a direct-current voltage having a negative polarity was supplied to the collecting roller 51 after the image forming operation performed at 100 kPV had ended as in the exemplary embodiment, it was confirmed that the second transfer rate was improved.

Second Exemplary Embodiment

Figure 10:
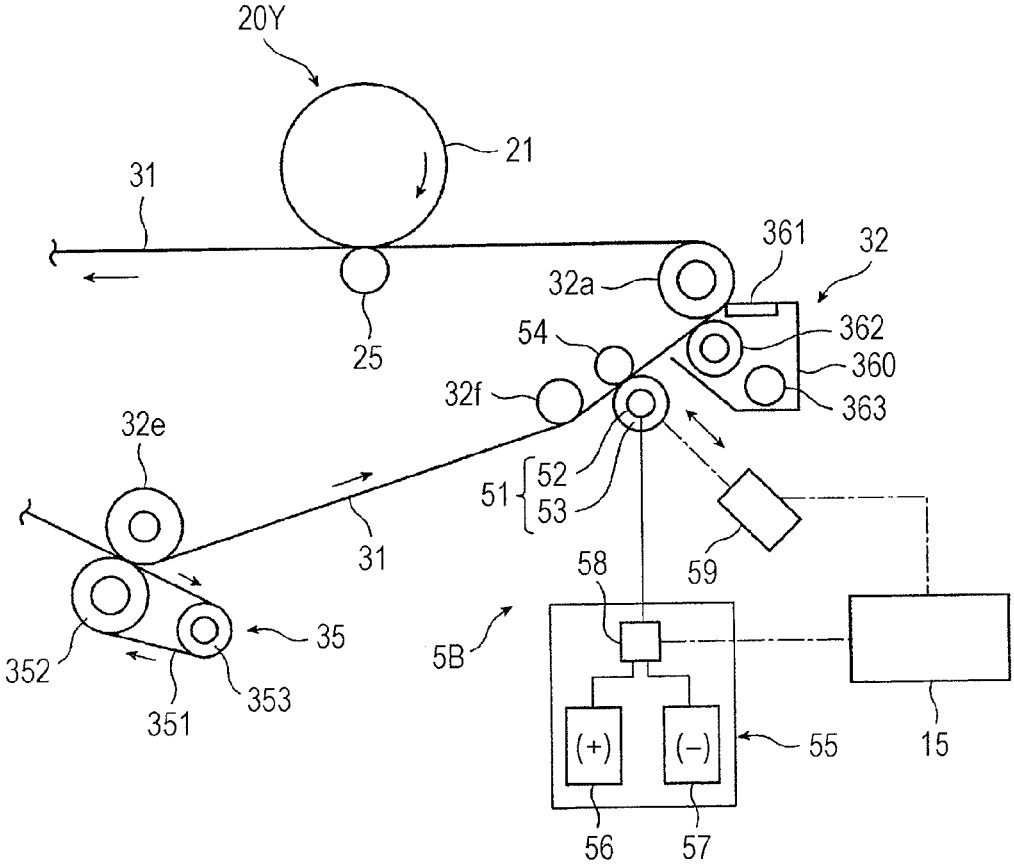
FIG. 10 is an enlarged view of principal portions (collecting device, belt cleaning device, etc.) of an image forming apparatus according to a second exemplary embodiment.

FIG. 10 shows principal portions (collecting device, etc.) of an image forming apparatus 1 according to a second exemplary embodiment. A collecting device 5B according to the second exemplary embodiment has the same structure as the collecting device 5 according to the first exemplary embodiment except that a contacting/separating device 59 that causes a collecting roller 51 to be in a state of contact with and in a state of separation from an outer peripheral surface 31*a* of an intermediate transfer belt 31 is added.

Figure 11:
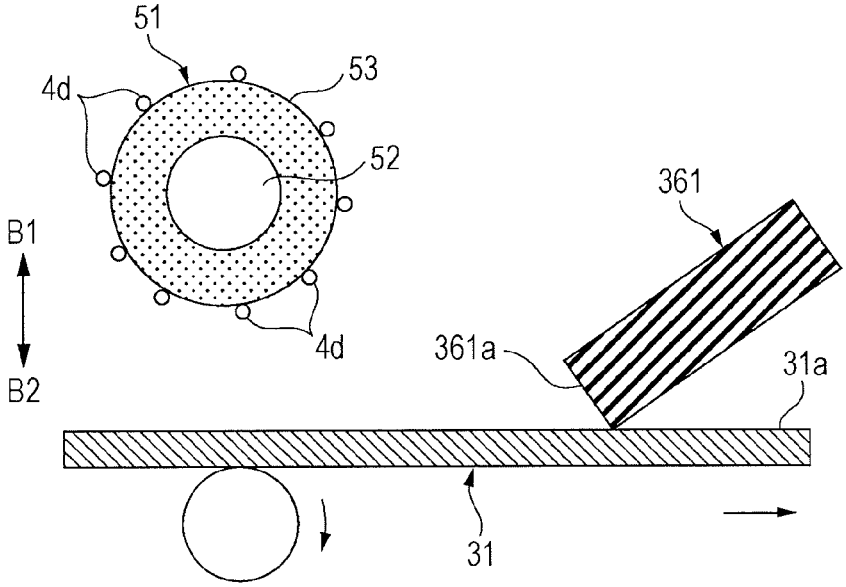
FIG. 11 is a schematic view of, for example, a state in which a collecting roller is separated from an intermediate transfer belt in the image forming apparatus shown in FIG. 10.

As shown in FIG. 11, the contacting/separating device 59 is capable of performing an operation causing the collecting roller 51 to move in the direction of arrow B1 and to be in a state of separation from the outer peripheral surface 31*a* of the intermediate transfer belt 31 and an operation causing the collecting roller 51 to move in the direction of arrow B2 and to be in a contact state with the outer peripheral surface 31*a* of the intermediate transfer belt 31. For a structure of, for example, a contacting/separating system, a publicly known structure may be used. The operation of the contacting/separating device 59 is controlled by a controlling device 15.

In the image forming apparatus 1 including the collecting device 5B, initially, as shown in FIG. 10, the collecting roller 51 of the collecting device 5B is in a contact state with the outer peripheral surface 31*a* of the intermediate transfer belt 31. As in the collecting device 5 according to the first exemplary embodiment, first, when it is determined that the intermediate transfer belt 31 is in a first rotation period, a direct-current voltage having a positive polarity is supplied to the collecting roller 51 from a power supplying device 55 in the collecting device 5B (ST10, ST11 in FIG. 4). This causes the collecting roller 51 to electrostatically remove and hold PTFE resin particles 4*b* and 4*c* existing at the outer peripheral surface 31*a* of the intermediate transfer belt 31 that is not used (that is, a collecting operation is executed).

Next, in the collecting device 5B, if it is determined that the first rotation period has passed, as indicated by an alternate long and two short dashes line in FIG. 4, the contacting/separating device 59 causes the collecting roller 51 to be in a state of separation from the outer peripheral surface 31*a* of the intermediate transfer belt 31 (ST15) on the basis of a control command from the controlling device 15, and the supply of the direct-current voltage having a positive polarity from the power supplying device 55 is stopped on the basis of a control command from the controlling device 15 (ST13).

By this, as shown in FIG. 11, the collecting roller 51 is in the state of separation from the outer peripheral surface 31*a* of the intermediate transfer belt 31 while the collecting roller 51 holds removed PTFE resin particles 4*d*, and is set in a state in which a direct-current voltage having a positive polarity is not applied. As a result, even if a subsequent image forming operation is performed, residual toner remaining after the second transfer on the collecting roller 51 is reliably prevented from accidently adhering to the collecting roller 51. When the collecting roller 51 is in the state of separation from the outer peripheral surface 31*a* of the intermediate transfer belt 31, the supply of direct-current voltage having a positive polarity from the power supplying device 55 may be continued. This makes it possible for the removed PTFE resin particles 4*d* to be reliably held electrostatically by the collecting roller 51.

In the collecting device 5B, as shown in FIG. 6, when after the collecting operation, it is determined that the number of sheets on which images have been formed has reached a threshold value (ST20), the contacting/separating device 59 sets the collecting roller 51 in a state of contact with the outer peripheral surface 31*a* of the intermediate transfer belt 31 on the basis of a control command from the controlling device 15 (ST25), or a direct-current voltage having a negative polarity from the power supplying device 55 is supplied to the collecting roller 51 on the basis of a control command from the controlling device 15 (ST21).

By this, as schematically shown in FIG. 7, as in the collecting device 5 according to the first exemplary embodiment, the PTFE resin particles 4*d* held by the collecting roller 51 are ejected from the collecting roller 51, and are returned as resin particles 4*f* to the outer peripheral surface 31*a* of the intermediate transfer belt 31 (that is, an ejecting operation is performed).

Thereafter, when the controlling device 15 determines that the period of supply of bias voltage having a negative polarity has passed (ST22), the supply of direct-current voltage having a negative polarity to the collecting roller 51 from the power supplying device 55 of the collecting device 5B is stopped on the basis of a control command from the controlling device 15 (ST23).

Other Exemplary Embodiments

In the collecting devices 5 and 5B, if at least the collecting roller 51 is capable of removing and holding the PTFE resin particles 4*b* and 4*c*, the power supplying device 55 may be omitted. As regards the power supplying device 55, if the PTFE resin particles 4*d* collected and held by the collecting roller 51 are not to be ejected and returned to the intermediate transfer belt 31, the power supplying device 55 may have a structure that is only capable of supplying bias voltage to the collecting roller 51 for electrostatically removing and holding the resin particles 4*b* and 4*c*.

In the collecting devices 5 and 5B, instead of using the collecting roller 51 including the porous layer 53, other members, such as rotating brushes, may be used as collecting members that contact the outer peripheral surface 31*a* of the intermediate transfer belt. When a collecting member that rotates is used, the collecting member that rotates may be formed so as to rotate when a difference in speed occurs between the collecting member that rotates and the intermediate transfer belt 31. This makes it possible to reliably remove the resin particles.

Further, it is possible to use a non-rotating stationary member as the collecting member. When a stationary collecting member is used, it is desirable to set the contacting/separating device 59 that causes the collecting member to be in a state of contact with and to be in a state of separation from the outer peripheral surface 31*a* of the intermediate transfer belt. This makes it possible for the collecting member to be in the state of separation from the outer peripheral surface 31*a* of the intermediate transfer belt in a period when resin particles are not to be collected by the stationary collecting member. Therefore, it is possible to prevent undesired substances, such as toner particles, from adhering to the collecting member, so that the surface of the collecting member is capable of being maintained in a clean state.

As long as the intermediate transfer belt 31 in which the PTFE resin particles are dispersed and the belt cleaning device 36 including the cleaning plate 361 are used, the form, etc., of the image forming apparatus 1 including, for example, the collecting device 5 or 5B is not particularly limited. For example, the image forming apparatus 1 may including one image forming device 20. In addition, the second transfer device 35 may include one second transfer roller. The collecting device 5 or 5B according to the exemplary embodiment of the invention may also be applied to an image forming apparatus in which the belt cleaning device 36 is disposed in a section that is situated upstream from the second transfer position and that is situated downstream from the first transfer portions of the image forming devices 20.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming device including an image holding member, a developer image developed with a developer being formed on the image holding member;

an intermediate transfer belt that holds on an outer surface thereof the developer image formed on the image holding member of the image forming device, and that rotates so as to transport the developer image up to a second transfer section where the developer image is transferred to a recording material, the intermediate transfer belt including a belt base material in which a resin particle formed of polytetrafluoroethylene is dispersed;

a cleaning device including a plate member and a rotation member disposed at an upstream side of the plate member, the cleaning device performing a cleaning operation by at least contacting the plate member and the rotation member with a portion of an outer peripheral surface of the intermediate transfer belt that has passed the second transfer section; and a collecting member that is disposed so as to be contactable with a portion of the outer peripheral surface of the intermediate transfer belt that is disposed upstream in a direction of rotation from and that is close to a position where the plate member of the cleaning device contacts the intermediate transfer belt, the collecting member removing and holding the resin particle existing at the outer peripheral surface of the intermediate transfer belt at least when the intermediate transfer belt is not used;

a contacting/separating unit that causes the collecting roller to be in a state of contact with and in a state of separation from the outer peripheral surface of the intermediate transfer belt, wherein, after passage of an initial stage when the intermediate transfer belt is rotated for a first time, the contacting/separating unit causes the collecting member to be in the state of separation from the outer peripheral surface of the intermediate transfer belt, wherein, when a cumulative amount of the rotation of the intermediate transfer belt has reached a predetermined value, the contacting/separating unit causes the collecting member to be in the state of contact with the outer peripheral surface of the intermediate transfer belt.

2. The image forming apparatus according to claim 1, wherein the collecting member includes a porous portion that contacts the outer peripheral surface of the intermediate transfer belt.

3. The image forming apparatus according to claim 1, further comprising a power supplying unit that selects a bias voltage having a different polarity, and supplies the bias voltage to the collecting member.

4. The image forming apparatus according to claim 3, wherein, at an initial stage when the intermediate transfer belt is rotated for a first time, a bias voltage having a polarity that is opposite to a charging polarity of the resin particle is supplied to the collecting member from the power supplying unit.

5. The image forming apparatus according to claim 3, wherein, after passage of an initial stage when the intermediate transfer belt is rotated for a first time, the supply of the bias voltage to the collecting member from the power supplying unit is stopped.

6. The image forming apparatus according to claim 3, wherein, when a cumulative amount of the rotation of the intermediate transfer belt has reached a predetermined value, a bias voltage having a polarity that is the same as a charging polarity of the resin particle is supplied to the collecting member from the power supplying unit.

7. The image forming apparatus according to claim 1, further comprising a supporting member positioned to oppose the collecting member, the intermediate transfer belt being disposed in between the supporting member and the collecting member.

8. An image forming apparatus comprising:

an image forming device including an image holding member, a developer image developed with a developer being formed on the image holding member;

an intermediate transfer belt that holds on an outer surface thereof the developer image formed on the image holding member of the image forming device, and that rotates so as to transport the developer image up to a second transfer section where the developer image is transferred to a recording material, the intermediate transfer belt including: a belt base material in which a resin particle formed of polytetrafluoroethylene is dispersed, a surface material of the belt being same as the belt base material, and a resin particle existing in a partially exposed state to the outer surface;

a cleaning device including a plate member and a rotation member disposed at an upstream side of the plate member, the cleaning device performing a cleaning operation by at least contacting the plate member and the rotation member with a portion of an outer peripheral surface of the intermediate transfer belt that has passed the second transfer section; and a collecting member that is disposed so as to be contactable with a portion of the outer peripheral surface of the intermediate transfer belt that is disposed upstream in a direction of rotation from and that is close to a position where the plate member of the cleaning device contacts the intermediate transfer belt, the collecting member removing and holding the resin particle existing at the outer peripheral surface of the intermediate transfer belt at least when the intermediate transfer belt is not used;

a contacting/separating unit that causes the collecting roller to be in a state of contact with and in a state of separation from the outer peripheral surface of the intermediate transfer belt, wherein, after passage of an initial stage when the intermediate transfer belt is rotated for a first time, the contacting/separating unit causes the collecting member to be in the state of separation from the outer peripheral surface of the intermediate transfer belt, wherein, when a cumulative amount of the rotation of the intermediate transfer belt has reached a predetermined value, the contacting/separating unit causes the collecting member to be in the state of contact with the outer peripheral surface of the intermediate transfer belt.

9. An image forming apparatus comprising:

an image forming device including an image holding member, a developer image developed with a developer being formed on the image holding member;

an intermediate transfer belt that holds on an outer surface thereof the developer image formed on the image holding member of the image forming device, and that rotates so as to transport the developer image up to a second transfer section where the developer image is transferred to a recording material, the intermediate transfer belt including a belt base material in which a resin particle formed of polytetrafluoroethylene is dispersed;

a cleaning device including a plate member, the cleaning device performing a cleaning operation by at least contacting the plate member with a portion of an outer peripheral surface of the intermediate transfer belt that has passed the second transfer section; and a collecting member that is disposed so as to be contactable with a portion of the outer peripheral surface of the intermediate transfer belt that is disposed upstream in a direction of rotation from and that is close to a position where the plate member of the cleaning device contacts the intermediate transfer belt, the collecting member removing and holding the resin particle existing at the outer peripheral surface of the intermediate transfer belt at least when the intermediate transfer belt is not used;

a power supplying unit that selects a bias voltage having a different polarity, and supplies the bias voltage to the collecting member; and a contacting/separating unit that causes the collecting roller to be in a state of contact with and in a state of separation from the outer peripheral surface of the intermediate transfer belt, wherein, after passage of an initial stage when the intermediate transfer belt is rotated for a first time, the contacting/separating unit causes the collecting member to be in the state of separation from the outer peripheral surface of the intermediate transfer belt, wherein, when a cumulative amount of the rotation of the intermediate transfer belt has reached a predetermined value, the contacting/separating unit causes the collecting member to be in the state of contact with the outer peripheral surface of the intermediate transfer belt, and a bias voltage having a polarity that is the same as a charging polarity of the resin particle is supplied to the collecting member from the power supplying unit.

* * * * *